US009255722B2

(12) United States Patent
Kim et al.

(10) Patent No.: US 9,255,722 B2
(45) Date of Patent: Feb. 9, 2016

(54) AIR CONDITIONER HAVING A MOVABLE PANEL THAT OPENS AND CLOSES DISCHARGE PORTS

(71) Applicant: LG ELECTRONICS INC., Seoul (KR)

(72) Inventors: Hyunjung Kim, Changwon-si (KR); Jongsun Jeon, Changwon-si (KR); Moonsung Kim, Changwon-si (KR); Jaeseung Choi, Changwon-si (KR); Hayoung Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 133 days.

(21) Appl. No.: 13/954,160

(22) Filed: Jul. 30, 2013

(65) Prior Publication Data

US 2014/0097730 A1 Apr. 10, 2014

(30) Foreign Application Priority Data

Oct. 10, 2012 (KR) ..... 10-2012-0112221

(51) Int. Cl.

| | |
|---|---|
| ***F24F 13/24*** | (2006.01) |
| ***F24F 13/20*** | (2006.01) |
| ***F24F 13/075*** | (2006.01) |

(Continued)

(52) U.S. Cl.

CPC ..... *F24F 13/20* (2013.01); *F24F 1/0014* (2013.01); *F24F 13/075* (2013.01); *F24F 13/1413* (2013.01); *F24F 13/1486* (2013.01); *F24F 13/12* (2013.01); *F24F 2001/0048* (2013.01); *F24F2013/1473* (2013.01); *F24F 2221/26* (2013.01); *F24F 2221/54* (2013.01)

(58) Field of Classification Search

CPC ..... F24F 1/0014; F24F 13/075; F24F 13/10; F24F 13/12; F24F 13/14; F24F 13/1413; F24F 13/1486; F24F 13/15; F24F 13/20; F24F 2001/0048; F24F 13/1446; F24F 13/1473; F24F 2221/26; F24F 2221/54; E06B 3/08; E06B 3/50; E06B 3/5036; E06B 3/5009; E06B 7/082; E06B 7/084; E06B 7/092; E06B 7/096; F16H 19/04; B60H 1/00692; B60H 1/00028; B60H 2001/00092; B60H 2001/00107; B60H 2001/00728

USPC ..... 74/29, 30, 46, 79, 89.18, 422

See application file for complete search history.

(56) References Cited

U.S. PATENT DOCUMENTS

| | | | | |
|---|---|---|---|---|
| 3,420,592 | A * | 1/1969 | Ogata et al. | 312/204 |
| 5,299,978 | A * | 4/1994 | Dennis et al. | 454/285 |

(Continued)

FOREIGN PATENT DOCUMENTS

| | | |
|---|---|---|
| EP | 2014997 A1 | 1/2009 |
| EP | 2290296 A1 | 3/2011 |
| JP | 2009-041898 | 2/2009 |

OTHER PUBLICATIONS

European Search Report issued in Application No. 13164881.8 dated Aug. 6, 2013.

*Primary Examiner* — Mohammad M Ali
*Assistant Examiner* — Christopher R Zerphey
(74) *Attorney, Agent, or Firm* — Ked & Associates LLP

(57) ABSTRACT

An air conditioner is provided. The air conditioner may include a case, a first discharging port provided at a first side of the case and a second discharging port provided at a second side of the case, each selectively discharging air therefrom based on an operation mode of the air conditioner. A movable panel connected to the case may be movable between the first discharging port and the second discharging port. A transfer direction of the movable panel may also be determined based on the operation mode of the air conditioner.

15 Claims, 9 Drawing Sheets

(51) Int. Cl.

| | |
|---|---|
| ***F24F 13/14*** | (2006.01) |
| ***F24F 1/00*** | (2011.01) |
| *F24F 13/12* | (2006.01) |

(56) References Cited

U.S. PATENT DOCUMENTS

| | | | | |
|---|---|---|---|---|
| 6,131,336 | A * | 10/2000 | Krause et al. | 49/74.1 |
| 6,338,382 | B1 * | 1/2002 | Takahashi et al. | 165/96 |
| 2001/0052240 | A1 * | 12/2001 | Kim et al. | 62/409 |
| 2002/0084058 | A1 * | 7/2002 | Ozeki et al. | 165/42 |
| 2004/0126198 | A1 * | 7/2004 | Chen | 409/201 |
| 2006/0032260 | A1 * | 2/2006 | Kang | 62/317 |
| 2006/0037355 | A1 * | 2/2006 | Hwang et al. | 62/428 |
| 2009/0199583 | A1 * | 8/2009 | Jeon et al. | 62/259.1 |
| 2009/0241576 | A1 * | 10/2009 | Tsuji et al. | 62/259.1 |
| 2010/0288062 | A1 * | 11/2010 | Meyer | 74/25 |
| 2010/0307717 | A1 * | 12/2010 | Yamashita et al. | 165/96 |
| 2014/0099875 | A1 * | 4/2014 | Kim et al. | 454/322 |

* cited by examiner

AIR CONDITIONER HAVING A MOVABLE PANEL THAT OPENS AND CLOSES DISCHARGE PORTS

CROSS-REFERENCE TO RELATED APPLICATION(S)

This application claims priority under 35 U.S.C. §119 to Korean Application No. 10-2012-0112221 filed on Oct. 10, 2012, whose entire disclosure is hereby incorporated by reference.

BACKGROUND

1. Field

This relates to an air conditioner.

2. Background

Air conditioners maintain indoor air in a cool state in summer and in a warm state in winter, control humidity of indoor air, and purify the indoor air. Air conditioners, in which a refrigeration cycle is driven, may include a compressor, a condenser, an expansion device, and an evaporator.

Air conditioners may be classified into split type air conditioners with indoor units and outdoor units separated from one another and integral type air conditioners with indoor units and outdoor units integrally coupled with one another. Air conditioners may also be classified into wall-mounted type air conditioners, frame type air conditioners, standing type air conditioners.

Such an air conditioner may include a suction part suctioning air from within an indoor space, a heat exchanger performing heat-exchanged with the air suctioned via the suction part, a discharging part discharging the air heat-exchanged into the indoor space, and a blowing fan for generating an air movement from the suction part to the discharging part.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. However, embodiments may have many different forms and should not be construed as being limited to the embodiments set forth herein; rather, that alternate embodiments falling within the spirit and scope of the present disclosure may be derived through adding, altering, and changing, and will fully convey the concepts disclosed herein to those skilled in the art.

Figure 1:
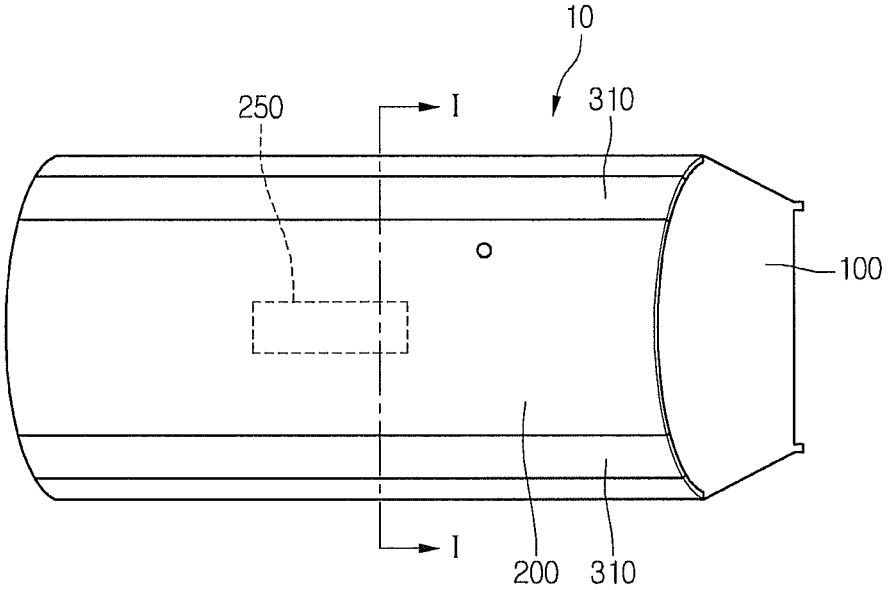
FIG. 1 is a perspective view of an air conditioner according to an embodiment as broadly described herein.
Figure 2:
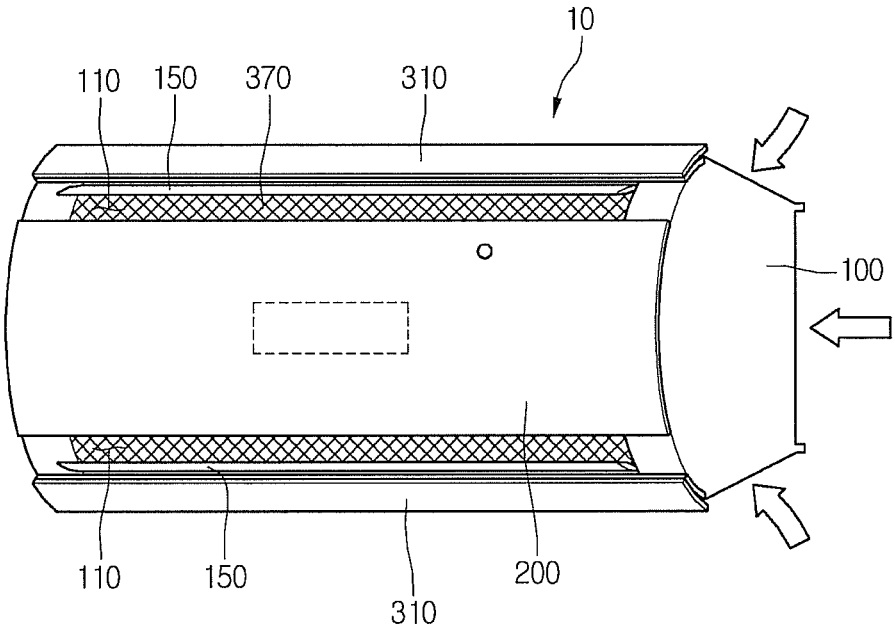
FIG. 2 is a perspective view of the air conditioner shown in FIG. 1, in an operation state.

Referring to FIGS. 1 and 2, an air conditioner 10 as embodied and broadly described herein may be installed on a wall. Other positions, such as, for example, a ceiling surface, may also be appropriate.

The air conditioner 10 may include a body 100 including an air inlet formed on one of a rear surface or a top surface thereof and discharging ports 110 formed on front top portion and bottom portion thereof, discharging panels 310 selectively exposing and shielding the discharging ports 110, discharging grills 370 having a mesh structure, a plurality of discharging vanes 150 rotatably provided in front of the discharging grills 370, and a movable panel 200 movable up and down between the discharging ports 110. An input device 250 may be provided on the moveable panel 200 to receive an operating command. For example, the input device 250 may receive a command to turn power of the air conditioner 10 on or off. A heat-exchanger and a blowing fan may be provided inside the body 100.

Figure 3:
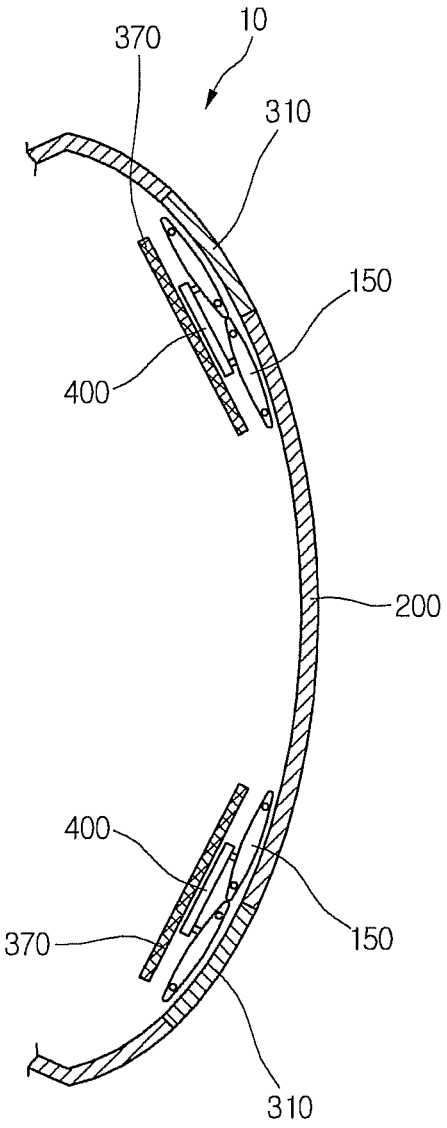
FIG. 3 is a side cross-sectional view of the air conditioner along a line I-I shown in FIG. 1.

FIG. 3 is a side cross-sectional view illustrating the air conditioner 10 taken along a line I-I shown in FIG. 1. Referring to FIG. 3, the discharging ports 110 provided at the front top and bottom portions of the body 100 may be selectively exposed and shielded by the discharging panels 310. Also, the discharging grills 370 may be respectively mounted on the discharging ports 110, and the discharging vanes 150 may be respectively mounted between the discharging grills 370 and the discharging panels 310. Each of the discharging ports 110 may have a plurality of the discharging vanes 150 provided therein. The respective discharging vanes 150 may be pivotable on a hinge axis provided along a top longitudinal edge and a bottom longitudinal edge of each of the discharging vanes 150. Accordingly, a center of rotation of the discharging vane 150 may pass horizontally through the top longitudinal edge and the bottom longitudinal edge thereof so that the respective centers of rotation are parallel to each other. The discharging vanes 150 may be pivoted downwardly or upwardly by a vane driver 400.

Figure 4:
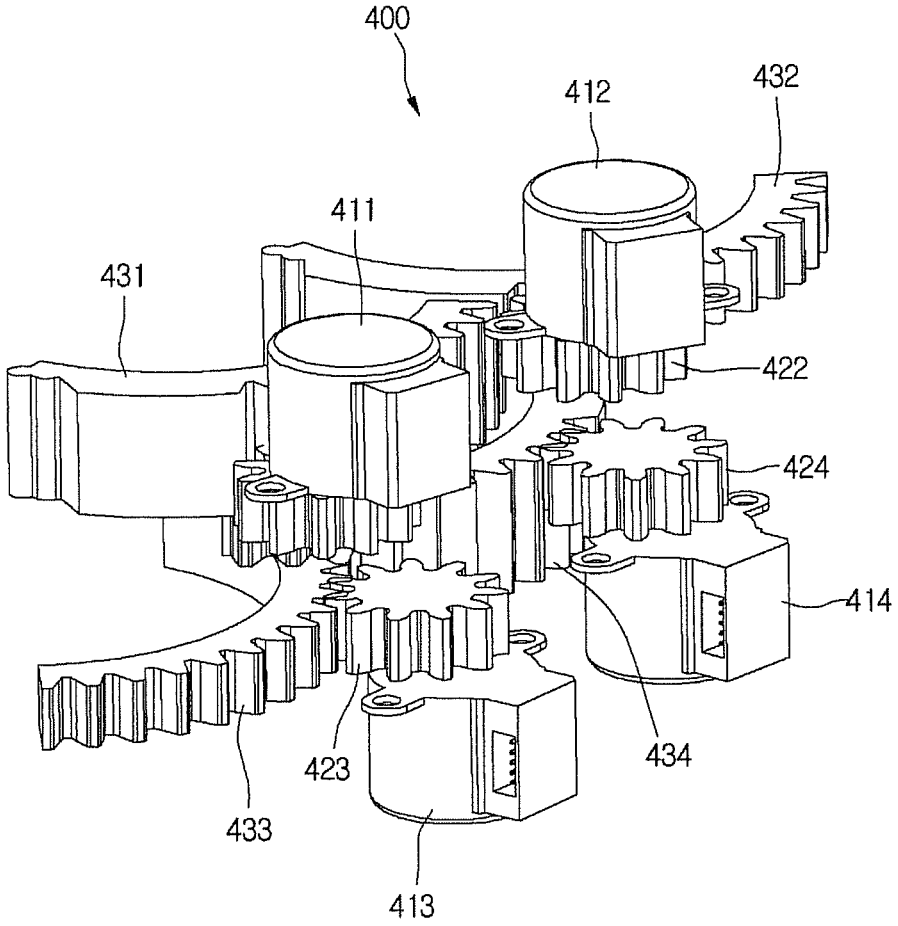
FIG. 4 is a perspective view a vane driver of the air conditioner shown in FIGS. 1-2.
Figure 5:
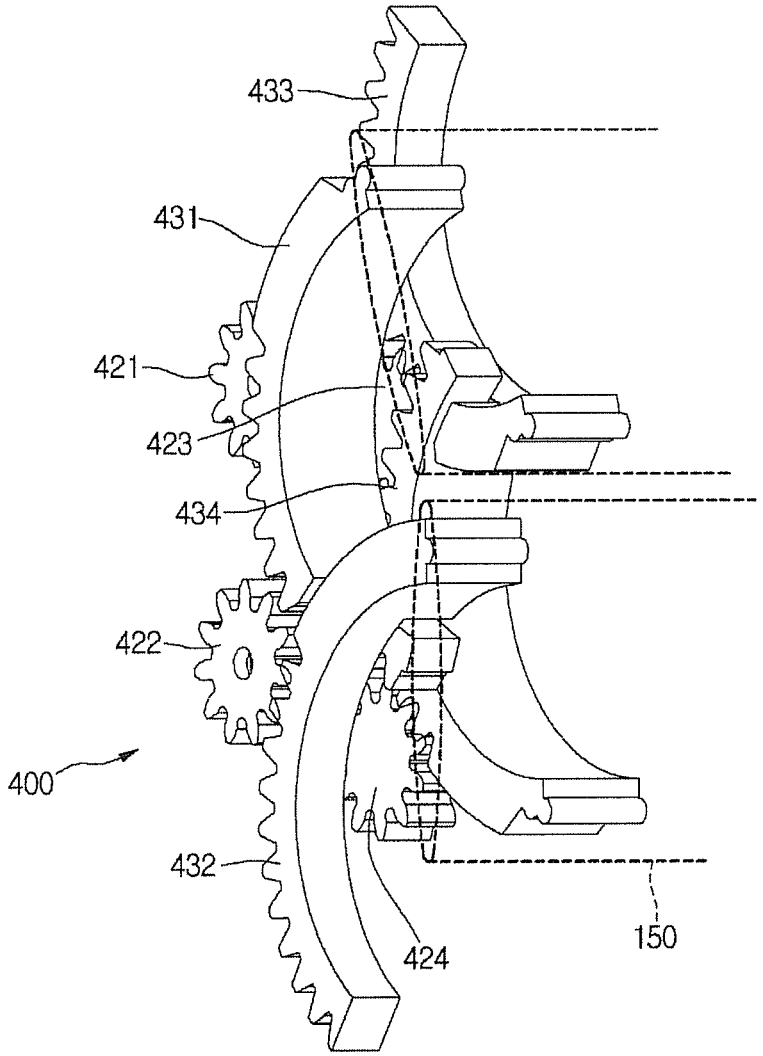
FIG. 5 is a perspective view of the vane driver excluding a driving motor.

FIG. 4 is a perspective view of the vane driver 400, and FIG. 5 is a perspective view of the vane driver 400 excluding a driving motor.

Referring to FIGS. 4 and 5, the vane driver 400 driving one or more of the discharging vanes 150, according to an embodiment as broadly described herein, may include a pivoting rack, a pinion engaged with the pivoting rack, and a driving motor providing a rotation force to the pinion.

In the embodiment shown in FIGS. 4-5, two discharging vanes 150 may be connected to one vane driver 400, and each of the two discharging vanes 150 may be connected to a pair of pivoting racks, a pair of pinions, and a pair of driving motors. In detail, upper pivoting racks 431 and 432 and lower pivoting racks 433 and 434 may be respectively connected to the two discharging vanes 150. Pinions 421 to 424 and driving motors 411 to 414 may respectively connected to the pivoting racks 431 to 434. Also, the upper pivoting racks 431 and 432 may be connected laterally to the lower pivoting racks 433 and 434, and each of the pivoting racks 431 to 434 may be formed with a certain curvature, to avoid interference. Gear teeth on an outer surface of each pivoting rack be coupled with the respective pinion. In this case, the lower pivoting racks 433 and 434 may be connected to the bottom edge of the discharging vane 150 and rotate the bottom edge, and the upper pivoting racks 431 and 432 may be connected to the top edge of the discharging vane 150 to rotate the top edge.

Figure 6:
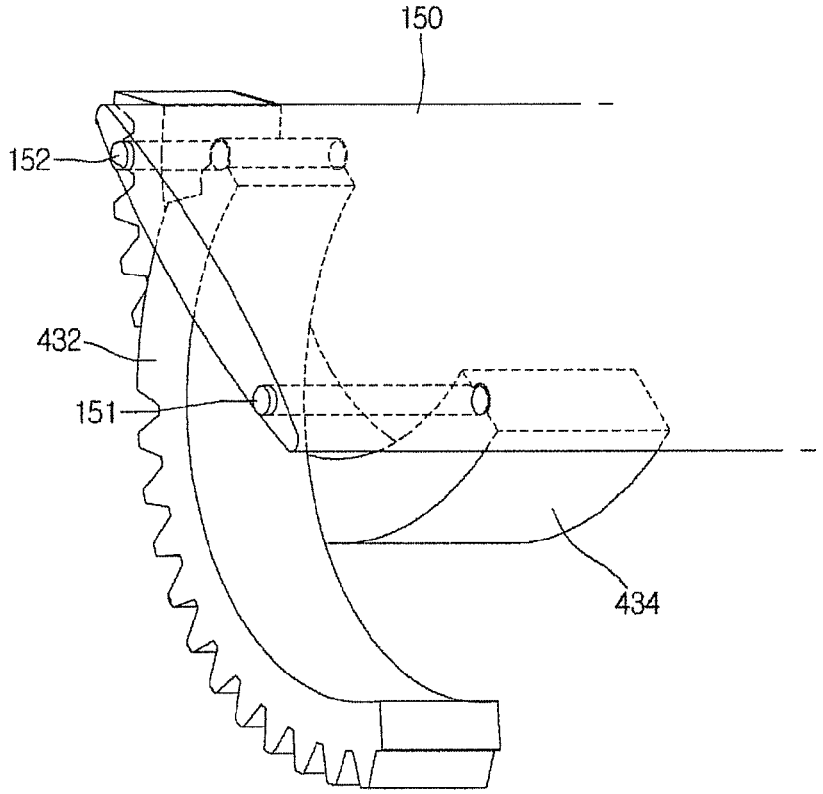
FIG. 6 is a partial perspective view of a pivoting rack connected to discharging vanes, according to an embodiment as broadly described herein.

FIG. 6 is a partial perspective view of the pivoting racks connected to the discharging vanes 150. Referring to FIG. 6, the upper pivoting rack 432 and the lower pivoting rack 434, as described above, are illustrated to facilitate explanation and are arranged to be separated from each other by a certain interval in a horizontal direction to avoid interference. The pivoting racks 432 and 434 may be provided on one or both of a left edge and a right edge of the discharging vane 150, with respective ends of the pivoting racks 432 and 434 connected to a rear (interior facing) side of the discharging vane 150.

In detail, one end of the upper pivoting rack 432 is pivotably connected to the hinge axis at an edge of a rear top end of the discharging vane 150, and the lower pivoting rack 434 is pivotably connected to the hinge axis at an edge of a rear bottom end of the discharging vane 150. In this exemplary embodiment, the upper pivoting rack 432 is disposed to a left side of the lower pivoting rack 434. In this case, for convenience, the hinge axis provided on the bottom edge of the discharging vane 150 is defined as a first hinge axis 151 and the hinge axis provided on the top edge is defined as a second hinge axis 152. Also, the lower pivoting rack connected to the first hinge axis 151 may be defined as a first pivoting rack, and the upper pivoting rack connected to the second hinge axis 152 may be defined as a second pivoting rack.

In the case of a single axis discharging vane configuration in which a rotation axis is formed along a central longitudinal axis of a discharging vane, or in which a rotation axis is formed only along one of a top longitudinal edge or a bottom longitudinal edge, such a discharging vane may only be capable of fully exposing or fully shielding a discharging outlet, and efficiency may decrease, especially in a mode in which air is to be discharged in a particular direction. That is, when a discharging vane is pivoted toward one of a top or a bottom direction, a large amount of the air cannot be discharged toward a desired direction, but only in a forward direction and via gaps formed between edges of the discharging port 110 and one of a bottom end or a top end of the discharging vane.

However, when the discharging vane can rotate about its two opposite longitudinal edges as in the present embodiment, prevailing, or directed, flow effects may be notably improved. In other words, since one of the top edge or the bottom edge of the discharging vane becomes a center of rotation while being rotated in a prevailing mode, a gap formed between the top edge or the bottom edge of the discharging port and the top end and the bottom end of the discharging vane become may be decreased. Comparing the gap between the top end and the bottom end of the discharging vane and the gap between the top edge and the bottom edge of the discharging part when the discharging vane with the rotation axis formed in the center thereof and the discharging vane according to the present embodiment rotated at the same angle, respectively, the gap formed in a configuration employing the discharging vane configuration according to the present embodiment may be smaller. This indicates that most of air is biased in a desired direction by the discharging vane as it is discharged.

Figure 7A:
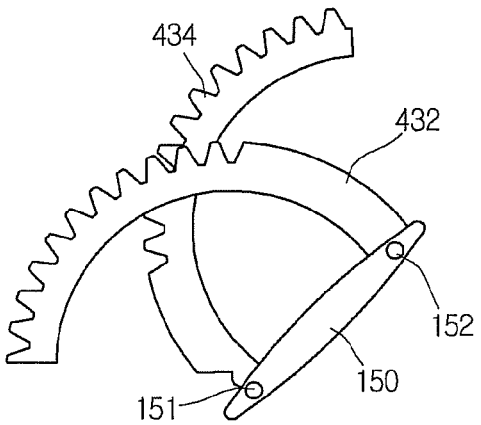
FIGS. 7A to 7C illustrate driving operations of the discharging vane.
Figure 7B:
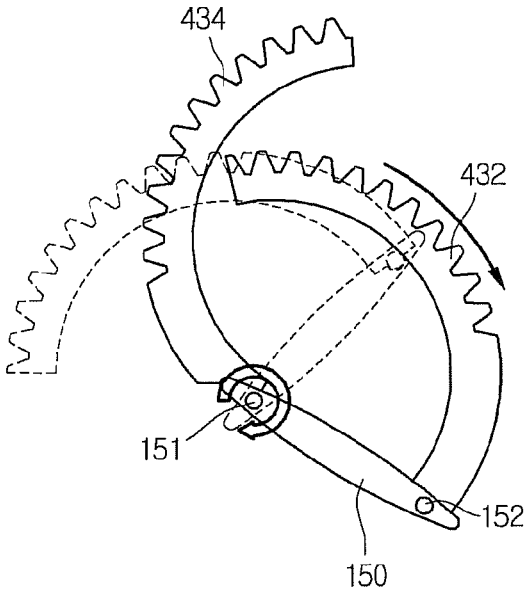
Figure 7C:
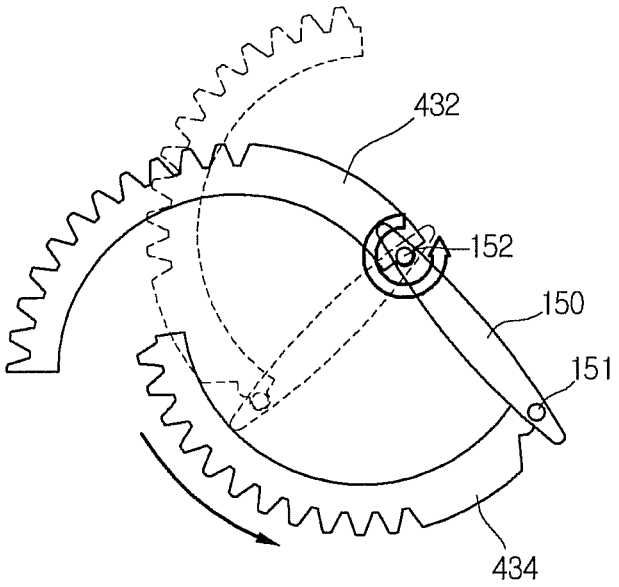

FIGS. 7A to 7C illustrate driving operations of the discharging vane 150 according to an embodiment. In particular, FIG. 7A illustrates the discharging vane 150 in a stationary state of the air conditioner 10. FIG. 7B illustrates the discharging vane 150 pivoted in an upward discharging condition in which the discharging vane 150 is pivoted about a lower rotation center (the first hinge axis 151), and the upper pivoting rack 432 is pivoted forward. Since the upper pivoting rack 432 has a certain curvature, when the pinion 422 engaged with the upper pivoting rack 432 is rotated by the driving motor 412, the upper pivoting rack 432 is pivoted along a circular arc around the first hinge axis 151. As a result, the discharging vane 150 is pivoted about the first hinge axis 151 to a certain angle. An amount of pivoting of the discharging vane 150 is determined by a length of the pivoting rack. FIG. 7C illustrates the discharging vane 150 pivoted in a downward discharging condition. In the downward discharging condition, the lower pivoting rack 434 is pivoted so that the discharging vane 150 is pivoted around the second hinge axis 152.

Figure 8:
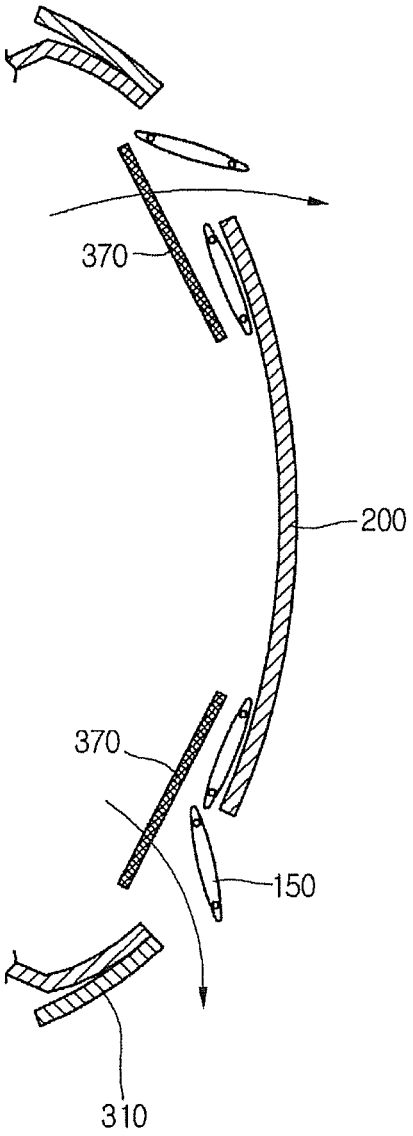
FIG. 8 is a partial cross-sectional view of the air conditioner in a downward discharging mode.

FIG. 8 is a partial cross-sectional view of the air conditioner 10 in a downward discharging mode.

Referring to FIG. 8, in the downward discharging mode, the movable panel 200 is located at a center position and the discharging panels 310 are transferred toward the top and bottom (outer) edges of the air conditioner 10, thereby exposing portions both discharging ports 110 above and below the movable panel 200. In this case, only parts of the full exposable areas of the respective discharging ports 110 are exposed. The discharge area exposed in this arrangement may be designated as a first discharging areas, and only one of the two discharging vanes 150 provided in each of the ports 110 is exposed when only the first discharging areas are exposed. In detail, the discharging vanes 150 located in the exposed discharging area are pivoted around the second hinge axes 152 as shown in the drawing. In other words, the discharging vanes 150 are pivoted counterclockwise around the second hinge axes 152. Accordingly, since air flow discharged from the inside of the air conditioner 10 is discharged toward a lower portion of an installation space thereof, the air flow does not necessarily go very far, depending on the installation position/height of the air conditioner 10.

Figure 9:
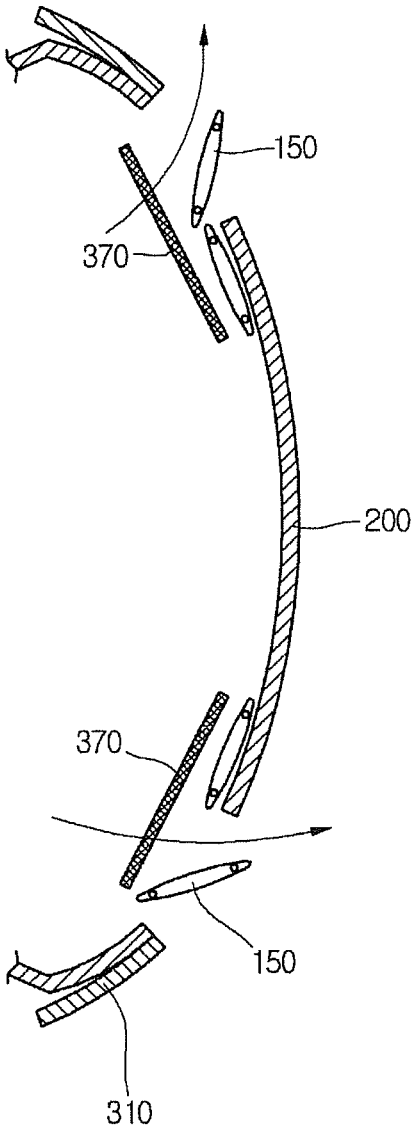
FIG. 9 is a partial cross-sectional view of the air conditioner in an upward discharging mode.

FIG. 9 is a partial cross-sectional view of the air conditioner 10 in an upward discharging mode.

Referring to FIG. 9, in the upward discharging mode, the movable panel 200 is located in the center, both the discharging panels 310 are in the open position, and only the first discharging areas of the discharging ports 110 are exposed, as described above. In the upward discharging mode, the discharging vanes 150 are pivoted around the first hinge axes 151 counterclockwise in the drawing. Then, since air flow discharged from the inside of the air conditioner 10 is discharged in an upward direction, the air flow may be discharged somewhat farther than that in the downward discharging mode, depending on the installation position/height of the air conditioner 10.

Figure 10:
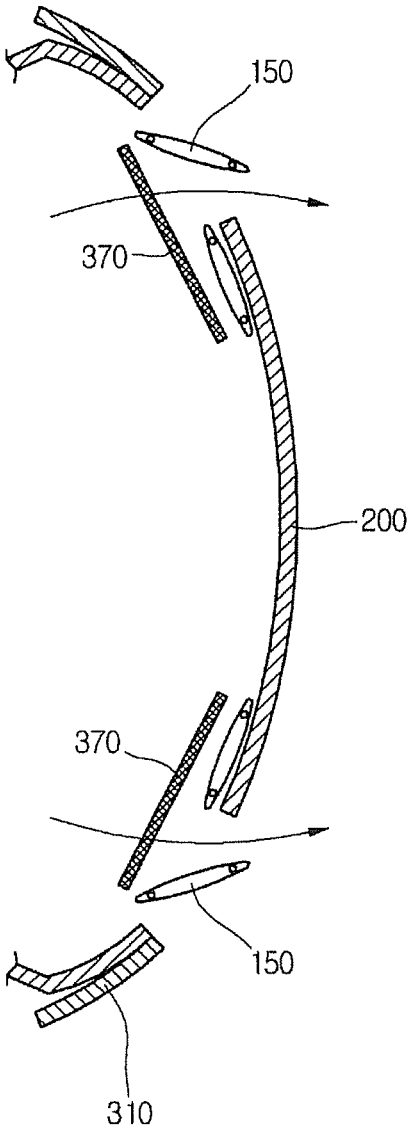
FIG. 10 is a partial cross-sectional view of the air conditioner in a forward discharging mode.

FIG. 10 is a partial cross-sectional view of the air conditioner 10 in a forward discharging mode. Referring to FIG. 10, in the forward discharging mode, the movable panel 200 is located at the center position and only the first discharging areas of the respective discharging ports 110 are exposed. Also, the discharging vanes 150 located in the first discharging area of the top discharging port 110 is pivoted counterclockwise around the second hinge axis 152, and the discharging vane 150 located in the first discharging area of the bottom discharging port 110 is pivoted clockwise around the first hinge axis 151. That is, the top and bottom discharging vanes 150 are pivoted so as to direct discharged air to a position in front of a center portion of the air conditioner 10, so that air is discharged in a somewhat straight line in front of the air conditioner 10.

Figure 11:
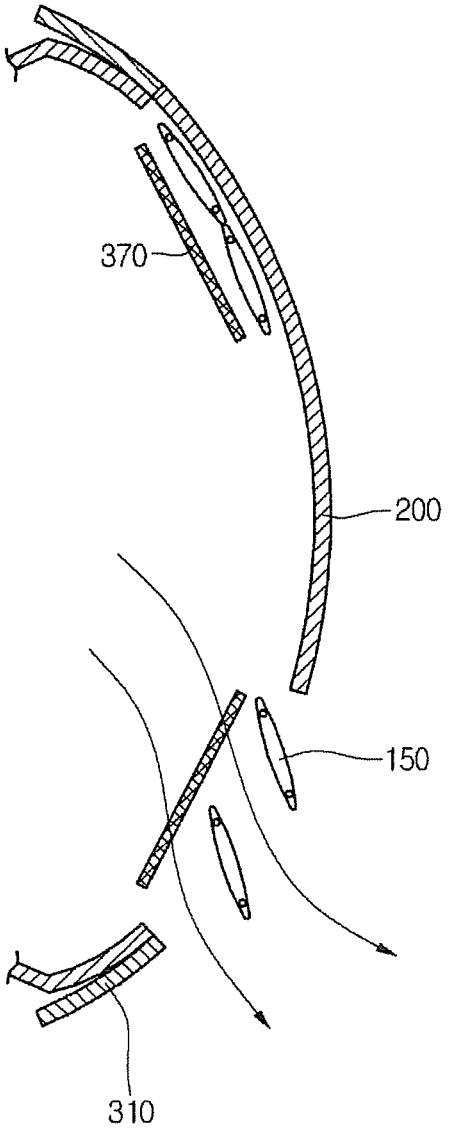
FIG. 11 is a partial cross-sectional view of the air conditioner in a heating mode.

FIG. 11 is a partial cross-sectional view of the air conditioner 10 in a heating mode. Referring to FIG. 11, in the winter when needing the heating mode, a temperature of indoor air is relatively low and typically gathers at a bottom portion of the installation space, with relatively high temperature air gathering at an upper portion of the installation space. Accordingly, to increase the indoor temperature in a short time, warm air discharged from the air conditioner 10 may be discharged toward the bottom portion of the installation space.

In the heating mode, similar to the previous modes, the discharging panels 310 are transferred to expose the first discharging areas of the discharging ports 110. The movable panel 200 may slide upward to fully shield the top discharging port 110 and fully expose the bottom discharging port 110. When the bottom discharging port 110 is fully exposed, the discharging areas in addition to the first discharging areas may be defined as second discharging areas. That is, each discharging port 110 may have a totally discharging area that is the sum of the first discharging area and the second discharging area.

In detail, when the bottom discharging port 110 is fully exposed, both of the discharging vanes 150 located at the bottom discharging port 110 become pivotable. In this case, the pair of discharging vanes 150 located at the bottom discharging port 110 are pivoted counterclockwise around their second hinge axes 152. Then, warm air discharged from the inside of the air conditioner 10 is discharged toward the bottom portion of the indoor space, so that cool air at the bottom of the indoor space is heated and the heated air ascends, thereby providing air circulation in the indoor space and an overall heating effect.

Figure 12:
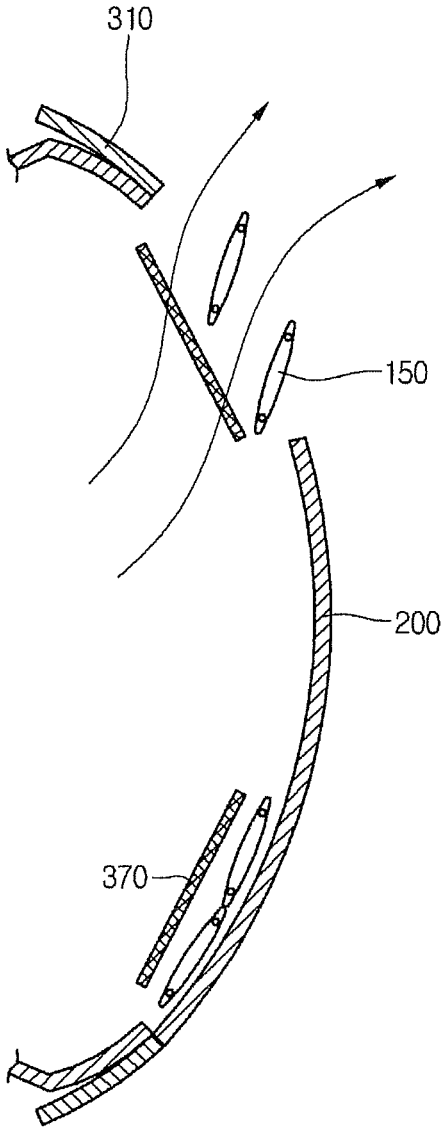
FIG. 12 is a partial cross-sectional view of the air conditioner in a cooling mode.

FIG. 12 is a partial cross-sectional view of the air conditioner 10 in a cooling mode. Referring to FIG. 12, since a temperature of indoor air is relatively high in the summer when needing the cooling mode, hot air is concentrated in a top area of the indoor space. Accordingly, in order to decrease a temperature of the indoor space in a short time, the top area where the hot air gathers may be cooled.

In the cooling mode, the discharging panels 310 are transferred to expose the first discharging areas of the discharging ports 110 and the movable panel 200 is transferred downwardly, so that the top discharging port 110 is fully exposed and the bottom discharging port 110 is fully shielded. In this case, both of the discharging vanes 150 located at the top discharging port 110 are pivoted clockwise with a certain angle about the first hinge axes 151. Then, cooled air generated by the air conditioner 10 is discharged toward the top area of the indoor space and mixed with the hot air in the top area of the indoor space so that it is cooled down and descends toward the bottom of the indoor space, thereby providing air circulation and overall cooling.

According to the present embodiment, discharging areas of discharging ports formed at top and bottom portions of the air conditioner may vary with certain operation modes, thereby more efficiently increasing or decreasing a temperature of an indoor space as appropriate.

According to the present embodiment, since discharging areas of the discharging ports may vary with movement of a movable panel, discharging areas may be adjusted to be suitable for a least one of a position of a user or an installation position of an air conditioner.

Additionally, since discharging direction may be varied/concentrated, customized operation may be provided.

Also, since discharging ports are provided both above and below of the movable panel and a direction and/or an amount of discharging air may be controlled the movable panel slides from one discharging port to another discharging may be simply controlled.

Also, after moving the discharging panels to expose the discharging ports and operate the air conditioner, it may be possible to control a method of discharging air by simply operating the movable panel, thereby increasing convenience of operation.

On the other hand, when the air conditioner is not operated, the discharging ports may be easily shielded by the movable panel and the discharging panels, thereby improving overall appearance.

Embodiments provide an air conditioner capable of effectively adjusting a direction or an amount of discharged air.

In one embodiment, an air conditioner as embodied and broadly described herein may include a case where an air inlet is formed, a first discharging part formed on one side of the case and discharging air, a second discharging part formed on another side of the case and discharging air, and a movable panel connected to the case and movable between the first discharging part and the second discharging part. A transfer direction of the movable panel may be determined according to an operation mode.

In another embodiment, an air conditioner as embodied and broadly described herein may include a movable panel, a case comprising a plurality of discharging parts formed by being divided by the movable panel and an air inlet formed a certain location separated from the plurality of discharging parts, and one or more discharging vanes provided at the plurality of discharging parts, respectively, The movable panel may be capable of being transferred to a direction of perfectly exposing or shielding any one of the plurality of discharging parts.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case including a front portion, the front portion including:

a first discharge port provided at a first side of the front portion of the case and configured to selectively discharge air; and a second discharge port provided at a second side of the front portion of the case and configured to selectively discharge air;

a movable panel coupled to the front portion of the case and configured to reciprocally slide between the first discharge port and the second discharge port, wherein the movable panel is configured to slide to partially open the first and second discharge ports or fully open one of the first discharge port or the second discharge port corresponding to a plurality of operation modes;

a first discharge panel moveably coupled to and disposed at the first side of the front portion of the case, to selectively open and close at least a portion of the first discharge port;

a second discharge panel moveably coupled Co and disposed at the second side of the front portion of the case, to selectively open and close at least a portion of the second discharge port;

a pair of discharging vanes provided at each of the first and second discharging ports wherein the pair of discharging vanes is arranged longitudinally and in parallel in the first discharging port and in the second discharging port, wherein a first hinge axis and a second hinge axis are provided at leading and trailing edges of each of the pair of discharging vanes, respectively, such that two horizontal axes of rotation are defined for each discharging vane;

a first rack having a first end connected to the first hinge axis of a corresponding discharge vane;

a second pivoting rack having a first end connected to the second hinge axis of the corresponding discharge vane;

a plurality of pinions respectively engaged with the first pivoting rack and the second pivoting rack; and a plurality of drive motors that rotates the plurality of pinions.

2. The air conditioner of claim 1, wherein the plurality of operation modes includes at least a cooling mode and a heating mode.

3. The air conditioner of claim 1, wherein the movable panel is sized to close a portion of the first discharge port and a portion of the second discharge port when the movable panel is oriented at a first position.

4. The air conditioner of claim 3, wherein the first position is a center position of the front portion of the case.

5. The air conditioner of claim 3, wherein the movable panel is sized to fully close one of the first discharge port or the second discharge port when the movable panel is oriented at a second position.

6. The air conditioner of claim 5, wherein the second position is a biased position from a center of the front portion of the case toward one of the first side or the second side of the front portion of the case.

7. The air conditioner of claim 1, wherein the first side of the front portion of the case is an upper portion of the front portion of the case, and wherein the second side of the front portion of the case is a lower portion of the front portion of the case.

8. The air conditioner of claim 7, wherein the movable panel is configured to slide in an upward direction or in a downward direction.

9. The air conditioner of claim 5, wherein each of the first discharge port and the second discharge port is divided into a plurality of discharge areas, wherein the first discharge panel is sized to selectively open or close one of the plurality of discharge areas of the first discharge port, and wherein the second discharge panel is sized to selectively open or close one of the plurality of discharge areas of the second discharge port.

10. The air conditioner of claim 9, wherein when the movable panel is at the first position, the movable panel is configured to close the other of the plurality of discharge areas of the first and second discharge ports.

11. The air conditioner of claim 9, wherein when the movable panel is at the second position, the movable panel is configured to fully close the plurality of discharge areas which is defined in one of the first discharge port or the second discharge port.

12. The air conditioner of claim 1, wherein the first pivoting rack and the second pivoting rack each has a predetermined curvature and crosses one another, and wherein the first pivoting rack and the second pivoting rack are separated from one another in a direction corresponding to the axes of rotation.

13. The air conditioner of claim 1, further comprising a pair of discharge grills having a mesh structure.

14. The air conditioner of claim 13, wherein the pair of discharge vanes is rotatably provided in front of the pair of discharge grills in the first and second discharge ports, respectively.

15. The air conditioner of claim 14, wherein the pair of discharge vanes is mounted between the pair of discharge grills and the first and second discharge panels, respectively.

* * * * *